United States Patent [19]

Suga

[11] Patent Number: 5,057,409

[45] Date of Patent: Oct. 15, 1991

[54] SILVER HALIDE PHOTOGRAPHIC MATERIAL

[75] Inventor: Yoichi Suga, Kanagawa, Japan

[73] Assignee: Fuji Photo Film Co., Ltd., Kanagawa, Japan

[21] Appl. No.: 264,554

[22] Filed: Oct. 31, 1988

[30] Foreign Application Priority Data

Oct. 30, 1987 [JP] Japan ..... 62-274841
Apr. 22, 1988 [JP] Japan ..... 63-99769

[51] Int. Cl.[5] ..... G03C 1/035
[52] U.S. Cl. ..... 430/567; 430/569
[58] Field of Search ..... 430/567, 569

[56] References Cited

U.S. PATENT DOCUMENTS 4,853,322 8/1989 Makino et al. ..... 430/567

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide photographic material comprising a support having thereon at least one silver halide emulsion layer, wherein the silver halide emulsion layer comprises a silver halide emulsion which satisfies condition (i) and wherein the silver halide emulsion layer or another silver halide emulsion layer having the same color sensitivity as that of the silver halide emulsion layer comprises a silver halide emulsion which satisfies condition (ii):

Condition (i): tabular grains having at least two twinning planes, a diameter of at least 0.15 μm and an average aspect ratio of at least 2 account for at least 70% of silver halide grains as calculated in terms of projected area and grains having a (b/a) ratio of at least 5 wherein (a) is the longest distance between the two or more parallel twinning planes and (b) is the grain thickness account for at least 50% of the tabular grains by number;

Condition (ii): grains having a diameter of at least 0.15 μm and an average aspect ratio of less than 2 account for at least 70% of silver halide grains as calculated in terms of projected area.

4 Claims, No Drawings

SILVER HALIDE PHOTOGRAPHIC MATERIAL

FIELD OF THE INVENTION

The present invention is directed toward a light-sensitive silver halide emulsion comprising high sensitivity parallel multiple twin grains having an improved graininess. More particularly, the present invention is directed toward a silver halide photographic material having improved pressure characteristics suitable for use in photography.

BACKGROUND OF THE INVENTION

In general, a photographic light-sensitive material comprising a coat of a silver halide emulsion is subject to various kinds of pressure. For example, ordinary photographic negative film is wound on a cartridge, bent when loaded into a camera or pulled when moved from one frame to another.

Further, a sheet film such as printing light-sensitive material and direct medical X-ray-sensitive material is often subject to bending due to handling.

Furthermore, any light-sensitive material is subject to a great pressure upon cutting or processing.

When a photographic light-sensitive material is subject to various kinds of pressure, silver halide grain is subject to pressure via the gelatin (binder) which carries silver halide grain or the plastic film (support). It is known that when silver halide grain is subject to pressure, the photographic light-sensitive material shows some change in photographic properties as reported in detail in K. B. Mather, *J. Opt. Soc. Am.*, 38, 1054 (1948), P. Faelens and P. de Smet, *Sci. et Ind Phot.*, 25, No. 5, 178 (1854) and P. Faelens, *J. Phot. Sci.*, 2, 105 (1954).

Therefore, it is desirable to provide a photographic light-sensitive material which is not susceptible to the effect of pressure upon the photographic properties.

Known methods for improving the pressure characteristics include providing the light-sensitive material with some plasticity from a polymer or emulsion or a method which comprises reducing the proportion of silver halide content to gelatin content in the silver halide emulsion. The following methods are intended to prevent pressure from reaching silver halide grains.

For example, British Patent No. 738,618 discloses a method which comprises using a heterocyclic compound to prevent undesirable changes in photographic properties due to pressure. British Patent No. 738,637 discloses a method which comprises using an alkyl phthalate. British Patent No. 738,639 discloses a method which comprises utilizing an alkyl ester. U.S. Pat. No. 2,960,404 discloses a method which comprises using a polyvalent alcohol. U.S. Pat. No. 3,121,060 discloses a method which comprises using a carboxyalkyl cellulose. JP-A-49-5017 (the term "JP-A" as used herein means an "unexamined published Japanese patent application") discloses a method which comprises using a paraffin and a carboxylic acid. JP-B-53-28086 (the term "JP-B" as used herein means an "examined Japanese patent publication") discloses a method which comprises using an alkyl acrylate and an organic acid.

However, the above described approach of providing the light-sensitive material with some plasticity is disadvantageous because the addition of an effective amount of these compounds results in a reduction in the mechanical strength of the emulsion layer. Thus, these compounds can only be added in limited amounts. This approach is also disadvantageous in that an increase in the added amount of gelatin causes a reduction in development speed. Thus, the known methods are ineffective.

In general, hexagon, octahedron, potato-shaped or spherical silver halide grain is less susceptible to deformation due to external pressure than tabular silver halide grain having a larger diameter/thickness ratio, because of their structure. Therefore, the above described methods may improve the pressure characteristics to a relatively small degree, but they do not improve pressure characteristics to a satisfactory level.

On the other hand, as the recent demand has grown for silver halide color negative films with a higher sensitivity and a smaller format, it has been keenly desired to provide a high sensitivity color negative photographic light-sensitive material which exhibits excellent picture quality.

In order to meet this requirement, a method which comprises the use of tabular grains for the purpose of improving the sensitivity (including the efficiency of color sensitization by a sensitizing dye), improving the relationship between the sensitivity and the graininess, improving the sharpness and improving the covering power is disclosed in U.S. Pat. Nos. 4,424,226, 4,414,310, 4,433,048, 4,414,306, and 4,459,353. Thus, tabular silver halide grain having a high aspect ratio is advantageous in that its properties are most desirable. However, an experiment showed that when tabular silver halide grain having a high aspect ratio (e.g., 8 or more) is incorporated in a layer other than the farthest light-sensitive layer from the support, particularly a green- or red-sensitive layer, in a so-called forward order layer structure (in the order of a blue-sensitive layer, a green-sensitive layer and a red-sensitive layer from the remote position of the support), the sharpness at a low frequency is deteriorated.

Japanese Patent Application No. 61-311130 discloses tabular silver halide grains having an aspect ratio of 8 or less which are intended to solve the above described problem.

However, tabular silver halide grains are remarkably weak to external forces due to their structure. Therefore, the above described method cannot provide tabular silver halide grains with satisfactory pressure characteristics. Tabular silver halide grains disclosed in Japanese Patent Application No. 61-311130 exhibits fog and an increase in sensitivity when subject to pressure. In order to improve such pressure characteristics, intensive studies have been undertaken. However, an effective approache has not been found.

Regarding the pressure characteristics of the negative portion of a negative paper system, it is known that since the fogged portion in the negative portion has a high density on the paper, the density change in this portion is hardly remarkable. Therefore, the pressure marks in the negative portion of a negative photographic light-sensitive material is of little consequence. However, the sensitization and desensitization, due to pressure in the gradation portion of a negative paper system, causes problems. These problems need to be eliminated.

SUMMARY OF THE INVENTION

Thus, the object of the present invention is to improve the pressure characteristics of a silver halide photographic light-sensitive material whereby silver halide grains having a high sensitivity, improved graininess and sharpness and parallel twinning planes are utilized.

The objects of the present invention are accomplished utilizing a silver halide photographic material comprising a support having thereon at least one silver halide emulsion layer, wherein the silver halide emulsion layer comprises a silver halide emulsion which satisfies condition (i) and wherein the silver halide emulsion layer or another silver halide emulsion layer having the same color sensitivity as that of the silver halide emulsion layer comprises a silver halide emulsion which satisfies condition (ii):

Condition (i): tabular grains having at least two twinning planes, a diameter of at least 0.15 μm and an average aspect ratio of at least 2 account for at least 70% of silver halide grains as calculated in terms of projected area and grains having a (b/a) ratio of at least 5 wherein (a) is the longest distance between the two or more parallel twinning planes and (b) is the grain thickness, account for at least 50% of the tabular grains by number;

Condition (ii); grains having a diameter of at least 0.15 μm and an average aspect ratio of less than 2 account for at least 70% of silver halide grains as calculated in terms of projected area.

In a preferred embodiment, the silver halide composition of the core of silver halide grains in the emulsion specified by Condition (ii) is silver haloiodide having a silver iodide content of at least 5 mol %, and the silver iodide content of the shell of the silver halide grains being at least 5 mol % lower than that of the core thereof. The coefficient of variation (CV) in the diameter of silver halide grains in the emulsion specified by Condition (ii) as calculated in terms of projected area is preferably 20% or less, and more preferably 15% or less.

The above and other objects of the present invention will become more apparent from the following detailed description and examples.

DETAILED DESCRIPTION OF THE INVENTION

The emulsion specified by Condition (i) and the emulsion specified by Condition (ii) may be present in the same light-sensitive layer or different light-sensitive layers having the same sensitivity.

The term "tabular grain" as used herein is a general term for grains having single twinning plane or two or more parallel twinning planes. The term "twinning plane" as used herein means a (111) plane wherein ions in all lattice points on both sides thereof are mirror reflected images of each other.

The grain thickness (b) is the distance between parallel basal plane surfaces. The measurement of grain thickness can be easily measured by a method which comprises depositing metal on a grain together with a latex bead as a reference, obliquely, and then measuring the length of the shadow of the grain by electron microphotography from which the thickness of the grain can easily be determined with the length of the shadow of the latex as a reference.

The term "grain diameter" as used herein means the diameter of the circle having the same area as the projected area of one of parallel basal plane surfaces of the grain.

The measurement of the distance (a) between twinning planes in the present invention will be described hereinafter.

The distance (a) between twinning planes is the distance between two twinning planes for a grain having two twinning planes or the largest value among the distances between twinning planes for a grain having three or more twinning planes.

The twinning planes can be observed by transmission electron microscopy.

More specifically, to prepare a specimen in which tabular grains are arranged substantially parallel to the support, an emulsion comprising tabular grains is coated onto a support. The specimen is then cut into serial sections by a diamond knife, with each section having a thickness of about 0.1 μm.

The twinning planes of tabular grains can be detected utilizing a transmission electron microscope to observe a section.

When an electron ray passes through a twinning plane, the electronic wave shows a phase shift from which the pressure of the twinning plane can be recognized.

The term "aspect ratio" as used herein means the value (D/b) obtained by dividing the diameter (D) of a tabular grain by the thickness (b) thereof. The term "average aspect ratio" as used herein means the value obtained by number-averaging the aspect ratio of all tabular grains.

The term "substantially monodisperse emulsion" as used herein means an emulsion having a silver halide grain size dispersion CV (i.e., coefficient of variation) of 20% or less, CV being determined by the following equation:

$$CV = \frac{S}{r} \times 100 = \sqrt{\frac{\Sigma(r_i - r)^2}{n-1}} \times \frac{100}{r} \ (\%)$$

$$r = \frac{\Sigma r_i}{n}$$

wherein n represents the number of grains to be measured; $r_i$ represents the size of the i-th grain (as calculated in terms of diameter of the circle having the same area as the projected area thereof); and S represents the standard deviation of grain sizes.

The composition of the tabular silver halide grains to be used in the present invention may be any one of silver bromide, silver iodobromide, silver chloride, silver chlorobromide, silver iodochloride and mixture thereof.

The tabular silver halide grain emulsion satisfying Condition (i) may have a structure such that the grain has at least two layers having substantially different halogen compositions therein or having a uniform halogen composition.

The tabular silver halide grain emulsion having layers with different halogen compositions may have a structure such that the core portion thereof has a high iodine content while the outermost layer has a low iodine content, or vice versa. Such a layer structure may consist of three or more layers. In this layer structure, the iodine content preferably decreases from the core to the surface thereof in order.

Grains contained in the tabular silver halide grain emulsion satisfying Condition (i) have an average aspect ratio of preferably 8.0 or less, more preferably 5.0 or less, particularly 1.1 to 5.0.

It is preferred for tabular silver halide grain emulsion satisfying Condition (i) that the tabular grains accounting for at least 70% of silver halide grains as calculated in terms of pojected area have a diameter within a range of from 0.2 μm to 2.0 μm.

It is also preferred for tabular silver halide grain emulsion satisfying Condition (i) that the tabular grains having at least two twinning planes, a diameter of at least 0.15 μm and an average aspect ratio of at least 2 account for at least 90% of silver halide grains as calculated in terms of projected area.

The present tabular silver halide grain emulsion satisfying the Condition (i) can be prepared by the precipitation method as described hereinafter. Particularly, a dispersant is charged into an ordinary silver halide precipitation reactor equipped with an agitating mechanism. The amount of the dispersant to be charged into the reactor at the first stage is normally in the range of at least about 10%, preferably 20 to 80% of the amount of the dispersant present in the silver bromoiodide emulsion at the final stage of precipitation of grains.

The term "first stage" as used herein means the stage of starting the reaction of $AgNO_3$ and potassium halide, and the term "final stage" as used herein means the stage of completion of the reaction of $AgNO_3$ and potassium halide.

The dispersant charged into the reactor at the first stage may be water or a water-dispersed peptizer. This dispersant may be optionally blended with other components, e.g., one or more silver halide solvents and/or metal doping agents as described later. If a peptizer is used at the beginning, the amount used is preferably in the range of at least 10%, particularly at least 20%, of the total amount of the peptizer present at the final stage of precipitation of silver iodobromide. Additional dispersant is charged into the reactor with a silver salt and halides. The introduction of these components may be conducted through separate jets. In order to increase the proportion of the peptizer, in particular, the introduction of the halide may be normally followed by an adjustment of the proportion of the dispersant.

Specific examples of the peptizer include gelatin, gelatin derivatives such as phthalated gelatin, albumin, agar-agar, gum arabic, cellulose derivatives, polyvinyl acetate, polyacrylamide, polyvinyl alcohol, etc. Of these, gelatin is preferably used.

Bromide is normally allowed to be present in the reactor at the initial stage in an amount of less than 10% by weight of the amount thereof to be used for the formation of silver iodobromide grains, so that the bromide ion content in the dispersant at the beginning of the precipitation of silver iodobromide is adjusted. The dispersant in the reactor is initially substantially free of iodine ion. This means that iodine ion is present in an amount insufficient to precipitate as a silver iodide phase as compared to bromide ion. The iodide content in the reactor before the introduction of the silver salt is preferably maintained at less than 0.5 mol % of the total halide ion content in the reactor.

During the precipitation of silver iodobromide grains, silver, bromide and iodide are charged into the reactor in accordance with a known precipitation method. An aqueous solution of a soluble salt such as silver nitrate is normally introduced into the reactor at the same time with the introduction of the bromide and iodide. Such a bromide and iodide may be introduced into the reactor in the form of an aqueous solution of salt, e.g., with soluble ammonium, alkaline metal (e.g., sodium or potassium) or alkaline earth metal (e.g., magnesium or calcium). The silver salt is introduced into the reactor separately from the bromide and iodide, at least at the stage of tabular grain nucleation. The bromide and the iodide may be introduced into the reactor separately or in admixture.

When the silver salt is introduced into the reactor, the nucleation of grains is initiated. As the introduction of the silver salt, the bromide and the iodide continues, the population of grain nuclei, which serves as positions at which silver iodide precipitates, is formed. The precipitation of silver bromide and silver iodide on the existing grain nucleus allows the grains to reach the stage of growth. The average value of the diameter of the tabular grains which don't yet reach the stage of grain growth as calculated in terms of a circle having the same area as the projected area thereof, is preferably 0.6 μm or less, particularly 0.4 μm or less. The nucleation of silver halide grains may be effected in accordance with the method as described in JP-A-63-11928, but the present invention should not be construed as being limited thereto. For example, the nucleating temperature can be selected from about 5° to 55° C.

The size distribution of the tabular grains formed according to the present invention is greatly affected by the concentration of bromide and iodide in the stage of grain growth. If the pBr value is too low, the resulting tabular silver halide grains have a high aspect ratio but show a remarkably great coefficient of variation in the projected area thereof. By maintaining the pBr at about 2.2 to 5, preferably 2.5 to 4, tabular grains having a small coefficient of variation in the projected area thereof can be formed.

With the proviso that the above described requirement for pBr range is met, the concentration of silver salt, bromide and iodide and the rate at which these components are introduced into the reactor may be the same as any commonly used range. The silver salt and the halides are preferably used in a concentration of 0.1 to 5 mol per l. However, this concentration value can be varied beyond the commonly used range. For example, this concentration value can be selected from 0.01 mol per l to the saturation point. A particularly preferred precipitation process is to increase the rate at which the silver salt and the halides are introduced into the reactor and shorten the precipitation time. The rate at which the silver salt and the halides are introduced into the reactor can be increased by increasing the rate at which the dispersant, the silver salt and the halides are introduced into the reactor or by increasing the concentration of the silver salt and the halides in the dispersant to be introduced. By maintaining the rate at which the silver salt and the halides are introduced at the vicinity of the critical value at which new grain nucleus are formed as described in JP-A-55-142329, the coefficient of variation in the projected area of grains can be further reduced.

The grain size distribution depends much on the amount of gelatin in the reactor during the nucleation. If the amount of gelatin is not optimized, the nucleation is not uniform. Particularly, the observation of twinning planes of grains made by the above described method, shows that the value of (b/a) has a great dispersion between grains. The gelatin concentration is preferably in the range of 0.5 to 10 wt %, particularly 0.5 to 6 wt % of the amount of water to be added to the reactor (before adding the silver salt).

The silver halide emulsion having an aspect ratio of 2 or more to be used in the present invention (i.e., the emulsion satisfying Condition (ii)) may comprise silver iodobromide, silver iodochloride or silver iodobromochloride.

The silver halide emulsion satisfying Condition (ii) may have either a uniform halogen composition or a core/shell structure. A silver halide emulsion having a core/shell structure as described hereinafter, is preferable.

In a preferred core/shell structure, the silver halide composition of the core portion thereof is silver haloiodide having a silver iodide content of at least 5 mol %, preferably 10 to 40 mol %, particularly preferably 20 to 40 mol %. The silver halide composition of the shell portion is silver haloiodide having a silver iodide content of at least 5 mol %, preferably at least 10 mol % lower than that of the core portion.

The core/shell type emulsion satisfying Condition (ii) to be used in the present invention may have a multiple layer structure. In this case, the layer having the highest iodide content is present in the center of the grain, and the difference in the iodide content between this layer and its adjacent layer is at least 5 mol %, preferably at least 10 mol %.

The present silver halide emulsion satisfying Condition (ii) comprising core/shell silver halide grains can be prepared by covering core silver halide grains incorporated in a monodisperse emulsion with a shell. The monodisperse silver halide core grains can be obtained by a double jet process in which the pAg and pH are properly controlled so that grains having the desired size are formed. The preparation of a highly monodisperse silver halide emulsion can be accomplished by any suitable method such as the one described in JP-A-54-48521. In a preferred embodiment of such a method, an aqueous solution of potassium iodobromide and gelatin and an ammoniacal aqueous solution of silver nitrate are added to an aqueous solution of gelatin containing silver halide grain species at a rate which varies as a function of time. In this method, a highly monodisperse silver halide emulsion can be obtained by properly selecting the time function of addition rate, pH value, pAg value, temperature, etc. Gelatin is a suitable binder for use in this method. Alternatively, gelatin derivatives (e.g., phthalated gelatin) or other hydrophilic high molecular colloids (e.g., polyvinyl alcohol, polyvinyl pyrrolidone) may be used.

The present silver halide emulsion may be allowed to grow in the presence of a known silver halide solvent (this process is hereinafter referred to as "solvent processing").

Examples of silver halide solvents which may be used in the present invention include organic thioethers as described in U.S. Pat. Nos. 3,271,157, 3,531,289, and 3,574,628, and JP-A-54-1019, and JP-A-54-158917, thiourea derivatives as described in JP-A-53-82408, JP-A-55-77737, and JP-A-55-29829, silver halide solvents containing a thiocarbonyl group bonded to an oxygen atom or a sulfur atom via a nitrogen atom as described in JP-A-53-144319, imidazoles as described in JP-A-54-100717, sulfites, thiocyanate, ammonia, hydroxyalkyl-substituted ethylenediamines as described in JP-A-57-196228, and substituted mercaptotetrazoles as described in JP-A-57-202531.

The reduction sensitization of the present silver halide emulsion can be effected at any point until the growth and solvent processing of grains is completed regardless of the halogen composition of the silver halide grains.

The silver halide grains incorporated in the core/shell type silver halide emulsion satisfying Condition (ii) of the present invention may have an average grain diameter of 0.1 to 4 μm, particularly 0.2 to 2 μm.

The present core/shell type light-sensitive silver halide emulsion may be subjected to doping with various metal salts or metal complexes during the formation (grain growth) of silver halide or physical ripening. For example, gold, platinum, palladium, rhodium, bismuth, cadmium, iridium or copper salts or complex salts or combinations thereof may be used.

In the present invention, the proportion of tabular grain emulsion of Condition (i) to core/shell type emulsion of Condition (ii) as calculated in terms of silver is in the range of 3:1 to 1:3, preferably 2:1 to 1:2.

Preferred silver halides other than the emulsions specified by Conditions (i) and (ii) incorporated in the photographic emulsion layer in the photographic light-sensitive material to be used in the present invention are silver iodobromide, silver iodochloride or silver iodochlorobromide having a silver iodide content of about 30 mol % or less. Particularly preferred is silver iodobromide having a silver iodide content of about 2 mol % to about 25 mol %.

The silver halide grains to be incorporated in the present photographic emulsion may have a regular crystal structure such as cube, octahedron and tetradecahedron, an irregular crystal structure such as a sphere and a plate, a crystal structure having crystal defects such as twinning plane, or a composite thereof.

The silver halide grains according to the present invention may be either finely divided grains having a grain diameter of about 0.2 μm or less or large sized grain having a grain diameter of up to about 10 μm as calculated in terms of projected area. The silver halide emulsion according to the present invention may be in the form of a monodisperse emulsion or a polydisperse emulsion.

The preparation of a silver halide photographic emulsion which can be used in the present invention can be accomplished by any suitable method such as these described in *Research Disclosure,* Nos. 17643 (December, 978), pp. 22 to 23, "I. Emulsion preparation and types", and 18716 (November, 1979), page 648, P. Glafkides, *Chemic et Phisique Photographique,* Paul Montel, 1967, G. F. Duffin, *Photographic Emulsion Chemistry,* Focal Press, 1966, and V. L. Zelikman et al., *Making and Coating Photographic Emulsion,* Focal Press, 1964.

Monodisperse emulsions as described in U.S. Pat. Nos. 3,574,628, and 3,655,394, and British Patent No. 1,413,748 may be preferably used in the present invention.

Alternatively, tabular grains having an aspect ratio of about 5 or more may be used in the present invention. The preparation of such tabular grains can be accomplished by any suitable method such as those described in Gutoff, *Photographic Science and Engineering,* Vol. 14, pp. 248 to 257, 1970, U.S. Pat. Nos. 4,434,226, 4,414,310, 4,433,048, and 4,439,520, and British Patent No. 2,112,157.

The crystal structure of the silver halide grains used in the present invention may be uniform, or such that the halide composition varies between the inner portion and the outer portion thereof, or may be layered as described in JP-A-53-103725, JP-A-59-162540, and *Phot. Sci. Eng.,* 25 [3] 96 (1981). Alternatively, silver halides having different compositions may be connected to each other by an epitaxial junction or by any suitable compound other than silver halide such as silver thiocyanate, and lead oxide.

Alternatively, a mixture or grains having various crystal structure may be used.

The silver halide emulsion used in the present invention may be normally subjected to physical ripening, chemical ripening, and spectral sensitization before use. Examples of additives to be used in such processes are described in *Research Disclosure,* Nos. 17643 and 18716. The places where such a description is found are summarized in the table shown below.

| Additives | RD 17643 | RD 18716 |
|---|---|---|
| 1. Chemical sensitizer | Page 23 | Right column on page 648 |
| 2. Sensitivity improver | | Right column on page 648 |
| 3. Spectral sensitizer, supersensitizer | Page 23 to page 24 | Right column on page 648 to right column on page 649 |
| 4. Brightening agent | Page 24 | |
| 5. Fog inhibitor, stabilizer | Page 24 to page 25 | Right column on page 649 |
| 6. Light absorber, filter dye, ultraviolet absorber | Page 25 to page 26 | Right column on page 649 to left column on page 650 |
| 7. Stain inhibitor | Right column on page 25 | Left column to right column on page 650 |
| 8. Dye image stabilizer | Page 25 | |
| 9. Film hardener | Page 26 | Left column on page 651 |
| 10. Binder | Page 26 | Left column on page 651 |
| 11. Plasticizer, lubricant | Page 27 | Right column on page 650 |
| 12. Coating aid, surface active agent | Page 26 to page 27 | Right column on page 650 |
| 13. Antistatic agent | Page 27 | Right column on page 650 |

Various color couplers can be used in the present invention. Specific examples of such color couplers are described in patents cited in *Research Disclosure,* No. 17643 (VII-C to G).

Preferred examples of yellow couplers which may be used in the present invention are described in U.S. Pat. Nos. 3,933,501, 4,022,620, 4,326,024, and 4,401,752, JP-B-58-10739, and British Patent Nos. 1,425,020, and 1,476,760.

As a magenta coupler there may be preferably used a 5-pyrazolone or pyrazoloazole compound. Particularly preferred examples of such a compound are described in U.S. Pat. Nos. 4,310,619, 4,351,897, 3,061,432, 3,725,067, 4,500,630, and 4,540,654, European Patent No. 73,636, JP-A-60-33552, and JP-A-60-43659, and *Research Disclosure* Nos. 24220 (June, 1984), and 24230 (June, 1984).

Preferred cyan couplers for use in the present invention include a phenolic or naphtholic coupler. Preferred examples of such cyan couplers are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,451,559 and 4,427,767, West German Patent Application (OLS) No. 3,329,729, and EP-A-121365 and EP-A-161626.

Examples of a colored coupler for correcting unnecessary absorption by color-forming dye are described in *Research Disclosure,* RD No. 17643, VII-G, U.S. Pat. Nos. 4,163,670, 4,004,929 and 4,138,258, British Patent 1,146,368, and JP-B-57-39413.

Examples of a coupler which provides a color-forming dye having an appropriate diffusibility are described in U.S. Pat. No. 4,366,237, British Patent 2,125,570, European Patent 96,570, and West German Patent Application (OLS) No. 3,234,533.

Typical examples of polymerized dye-forming couplers are described in U.S. Pat. Nos. 3,451,820, 4,080,211 and 4,367,282, and British Patent 2,102,173.

Couplers which release a photographically useful residual group upon coupling are preferably used in the present invention. Preferred examples of DIR couplers which release a development inhibitor are described in patents cited in *Research Disclosure,* RD No. 17643, VII-F, JP-A-57-151944, JP-A-57-154234 and JP-A-60-184248, and U.S. Pat. No. 4,248,962.

Preferred examples of couplers which imagewise release a nucleating agent and a development accelerator upon development are described in British Patents 2,097,140 and 2,131,188, and JP-A-59-157638 and JP-A-59-170840.

Examples of other couplers which can be used in the present light-sensitive material include competing couplers such as those described in U.S. Pat. No. 4,130,427, poly-equivalent couplers as described in U.S. Pat. Nos. 4,283,472, 4,338,393, and 4,310,618, DIR redox compound-releasing couplers as described in JP-A-60-185950, and couplers that release a dye which can be recovered after releasing as described in EP-A-173302.

The incorporation of the present couplers in the light-sensitive material can be accomplished by various known dispersion methods.

Examples of high boiling solvents which can be used in an oil-in-water dispersion process are described in U.S. Pat. No. 2,322,027.

Specific examples of process and effects of latex dispersion methods and latex for use in such dispersion methods are described in U.S. Pat. No. 4,199,363, and West German Patent Application (OLS) Nos. 2,541,274, and 2,541,230.

Examples of suitable supports which can be used in the present invention are described on page 28 of *Research Disclosure,* No. 17643 and from the right column on page 647 to the left column on page 648 in *Research Disclosure,* No. 18716.

The development of a color photographic light-sensitive material according to the present invention can be accomplished by ordinary methods such as those described in *Research Disclosure,* No. 17643 (pp. 28 to 29) and *Research Disclosure,* No. 18716 (left column to right column on page 651).

The color developing solution to be used in the development of the present light-sensitive material is preferably an alkaline aqueous solution containing an aromatic primary amine color developing agent as a main component. Color developing agents that may be used in the present invention include aminophenol compounds. Preferred examples of such color developing agents include p-phenylenediamine compounds. Typical examples of such p-phenylenediamine compounds include 3-methyl-4-amino-N,N-diethylaniline, 3-methyl-4 amino-N-ethyl-N-$\beta$-hydroxylethylaniline, 3-methyl-4-amino-N-ethyl-N-$\beta$-methanesulfonamideethylaniline, 3-methyl-4-amino-N-ethyl-N-$\beta$-methoxyethylaniline, and sulfate, hydrochloride, and p-toluenesulfonate thereof. These compounds may be used in combination depending on the application.

The color developing solution normally comprises pH buffers such as carbonate, borate, and phosphate of alkaline metal, and development inhibitors or fog inhibitors such as bromide, iodide, benzimidazoles, benzothiazoles, and mercapto compounds. Typical examples of other additives which may be optionally incorporated in the color developing solution include various preservatives such as hydroxylamine, diethylhydroxylamine, sulfite, hydrazines, phenyl semicarbazides, triethanolamine, catecholsulfonic acids and triethylenediamine(1,4-diazabicyclo[2,2,2]octane), organic solvents such as ethylene glycol and diethylene glycol, development accelerators such as benzyl alcohol, polyethylene glycol, quaternary ammonium salts and amines, dye-forming couplers, competing couplers, fogging agents such as sodium boron hydride, auxiliary developing agents such as 1-phenyl-3-pyrazolidone, viscosity imparting agents, and chelating agents such as aminopolycarboxylic acid, aminopolyphosphonic acid, alkylphosphonic acid and phosphonocarboxylic acid (e.g., ethylenediaminetetraacetic acid, nitrilotriacetic acid, diethylenetriaminepentaacetic acid, cyclohexanediaminetetraacetic acid , hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof).

In reversal processing of the light-sensitive material, color development normally follows a black-and-white development. Examples of black-and-white developing agents which can be incorporated in the black-and-white developing solution include dihydroxybenzenes such as hydroquinone, 3-pyrazolidones such as 1-phenyl-3-pyrazolidone, aminophenols such as N-methyl-p-aminophenol, and combinations thereof.

The pH value of these color developing solutions and black-and-white developing solutions is normally in the range of 9 to 12. The replenishing amount of these developing solutions depends on the color photographic light-sensitive material to be processed but is normally in the range of 3 liters or less per 1 $m^2$ of the light-sensitive material. By using a replenishing solution having lesser bromide ion content, the replenishing amount of these developing solutions can be reduced to 500 ml or less. If the replenishing amount of these developing solutions is reduced, the area of contact between the processing tank and air is preferably reduced to prevent evaporation and air oxidation of the solution. Alternatively, a means of inhibiting accumulation of bromide ion in the developing solution may be used to reduce the replenishing amount of the developing solution.

The photographic emulsion layer which has been color-developed is normally bleached. The bleaching may be effected simultaneously with fixing (i.e., blix) or separately from fixing. In order to expedite the processing, the bleaching may be followed by the blix. Furthermore, the photographic emulsion layer may be processed in two continuous blix baths. The fixing may be followed by the blix. Alternatively, the blix may be followed by the bleaching. These processes may be optionally selected depending on the purpose of application. Examples of bleaching agents which can be used in the present invention include compounds of polyvalent metal such as iron (III), cobalt (III), chromium (VI), and copper (II), peroxide, quinones, and nitro compounds. Typical examples of such bleaching agents include ferricyanides, bichromates, organic complex salts of iron (III) or cobalt (III) with, e.g., aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid and glycoletherdiaminetetraacetic acid, or citric acid, tartaric acid, malic acid, or other organic acid, persulfate, bromate, permanganate, and nitrobenzenes. Among these compounds, aminopolycarboxylic acid-iron (III) complex salts such as ethylenediaminetetraacetic acid-iron (III) complex salt and persulfate may be preferably used in light of rapidity in processing and prevention of environmental pollution. Furthermore, aminopolycarboxylic acid-iron (III) complex salts are particularly useful in the bleaching solution or blix solution. The pH value of a bleaching solution or blix solution comprising such an aminopolycarboxylic acid-iron (III) complex salt is normally in the range of 5.5 to 8. In order to expedite the processing, the pH value of the solution may be lower than this range.

The present bleaching solution, blix solution, or prebath thereof may optionally contain a bleach accelerator. Specific examples of useful bleach accelerators include compounds containing a mercapto group or a disulfide group as described in U.S. Pat. No. 3,893,858, West German Patent Nos. 1,290,812, and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, and JP-A-53-28426, and *Research Disclosure,* No. 17129 (July, 1978), thiazolidine derivatives as described in JP-A-50-140129, thiourea derivatives as described in JP-B-45-8506, JP-A-52-20832, and JP-A-53-32735, and U.S. Pat. No. 3,706,561, iodides as described in West German Patent No. 1,127,715, and JP-A-58-16235, polyoxyethylene compounds as described in West German Patent Nos. 966,410, and 2,748,430, polyamine compounds as described in JP-B-45-8836, compounds as described in JP-A-49-42434, JP-A-49-59644, JP-A-53-94927, JP-A-54-35727, JP-A-55-26506, and JP-A-58-163940, and bromide ion. Among these compounds, compounds containing mercapto groups or disulfide groups may be preferably used because of their high accelerating effect. Particularly preferred are compounds such as those described in U.S. Pat. No. 3,893,858, West German Patent No. 1,290,812, and JP-A-53-630. Furthermore, compounds as described in U.S. Pat. No. 4,552,834 may be preferably used. These bleach accelerators may be incorporated in the light-sensitive material. Further, these bleach accelerators are particularly useful when a color light-sensitive material is subjected to blix.

Examples of suitable fixing agents include thiosulfates, thiocyanates, thioether compounds, thioureas, and iodides (in a large amount). Among these compounds, thiosulfates are normally used. Particularly, ammonium thiosulfate can be most widely used. Suitable preservatives for use in the blix solution include sulfite, bisulfite and carbonyl-bisulfite addition products.

The present silver halide color photographic material having been subjected to desilvering process is normally then subjected to rinsing and/or stabilization. The amount of rinsing water to be used in the rinsing step can be widely varied depending on the characteristics of the light-sensitive material (due to materials used, e.g., couplers), the application of the light-sensitive material, the temperature of the rinsing water, the number of rinsing tanks (number of stages), the replenishing process (countercurrent or forward current), and various other conditions. Among these conditions, the relationship between the number of rinsing tanks and the amount of water used can be determined by the method as described in *Journal of the Society of Motion Picture and Television Engineering,* Vol. 64, pp. 248 to 253, (May, 955).

In a multistage countercurrent process as described in the above cited reference, the amount of rinsing water to be used can be drastically reduced. However, this process is disadvantageous in that the decrease in the time of retension of water in the tank causes propagation of bacteria which in turn produce suspended matter that can attach to the light-sensitive material. In the processing of the present color light-sensitive material, such a disadvantage can be effectively eliminated by the method as described in JP-A-62-288838 which comprises reducing the calcium and magnesium ion contents. Alternatively, the following compounds may be preferably used: isothiazolone compounds and thiabehdazoles as described in JP-A-57-8542, chlorinic sterilizers such as sodium chlorinated isocyanurate, or sterilizers as described in Hiroshi Horiguchi, *Ant-bacterial and Anti-fungal Chemistry,* Eisei Gijutsukai, *Technic for Sterilization and Fungicidal Treatment of Microorganism,* and Nihon Bokin Bobai Gakkai, *Dictionary of Sterilizers and Fungicides.*

The pH value of the rinsing water to be used in the processing of the present light-sensitive material is in the range of 4 to 9, preferably 5 to 8. The temperature of the rinsing water and the rinsing time can be widely varied depending on the characteristics and application of the light-sensitive material to be processed, but is normally in the range of 15° to 45° C. and 20 seconds to 10 minutes, preferably 25° to 40° C. and 30 seconds to 5 minutes, respectively. Furthermore, the present light-sensitive material can first be processed with a stabilizing solution instead of the above described rinsing solution. In such a stabilization process, any known method as described in JP-A-57-8543, JP-A-58-14834, and JP-A-60-220345 can be used.

The above described rinse may be optionally followed by another stabilization process such as a final stabilizing processing bath which contains formalin and a surface active agent. This stabilizing bath, too, may comprise various chelating agents or fungicides.

The overflow solution, produced by replenishing of the above described rinsing water and/or stabilizing solution, may be recycled at the desilvering step or other steps.

The present silver halide color light-sensitive material may comprise a color developing agent for the purpose of simplification and expedition of the processing. Such a color developing agent may be preferably incorporated in the form of various precursors. Examples of such precursors include indoaniline compounds as described in U.S. Pat. No. 3,342,597, Schiff's base type compounds as described in U.S. Pat. No. 3,342,599, and *Research Disclosure,* Nos. 14850 and 15159, aldol compounds as described in *Research Disclosure,* No. 13924, metal complexes as described in U.S. Pat. No. 3,719,492, and urethane compounds as described in JP-A-53-135628.

The present silver halide color light-sensitive material may optionally comprise various 1-phenyl-3-pyrazolidones for the purpose of promoting color development. Typical examples of such compounds are described in JP-A-56-64339, JP-A-57-144547, and JP-A-58-115438.

In the present invention, the various processing solutions can be used at a temperature of 10° to 50° C. These solutions are normally used at a temperature of 33° to 38° C. The temperature range may be raised to promote the processing and thus shorten the processing time. On the contrary, the temperature range may be lowered to improve the picture quality or the stability of the processing solutions. In order to save the silver content in the light-sensitive material, cobalt intensification or hydrogen peroxide intensification processes as described in West German Patent No. 2,226,770 and U.S. Pat. No. 3,674,499 can be used.

The silver halide light-sensitive material of the present invention can be also applied to heat-developable light-sensitive materials such as those described in U.S. Pat. No. 4,500,626, JP-A-60-133499, JP-A-59-218443, and JP-A-61-238056, and EP-A2-210660.

The present invention will be further described in the following examples, but the present invention should not be construed as being limited thereto.

EXAMPLE 1

Seven emulsions were prepared as shown in Table 1.

TABLE 1

| No. | Average grain size (μm) | Grain size distribution (CV) (%) | Structure | Iodine content (%) | Average aspect ratio | Proportion of grains of b/a ≧ 5 (%) | Remarks |
|---|---|---|---|---|---|---|---|
| A | 0.60 | 20 | Internal high AgI content type | Core 8<br>Shell 0<br>Average 4 | 3 | 80 | Condition (i) |
| B | 0.58 | 20 | Uniform AgI content type | 4 | 3 | 80 | Condition (i) |
| C | 0.70 | 30 | Uniform AgI content type | 4 | 1.8 | 20 | Condition (ii) |
| D | 0.75 | 10 | Uniform AgI content type | 4 | 1 | — | Condition (ii) |
| E | 0.75 | 10 | Internal high AgI content type | Core 30<br>Shell 0<br>Average 10 | 1 | — | Condition (ii) |
| F | 0.70 | 30 | Internal high AgI content type | Core 30<br>Shell 0<br>Average 10 | 1.8 | 20 | Condition (ii) |
| G | 0.90 | 25 | Uniform AgI content type | 4 | 8.5 | 85 | Condition (i) |
| H | 0.55 | 30 | Internal high AgI | Core 30 | 1.7 | 20 | Condition |

TABLE 1-continued

| No. | Average grain size (μm) | Grain size distribution (CV) (%) | Structure | Iodine content (%) | Average aspect ratio | Proportion of grains of b/a ≧ 5 (%) | Remarks |
|---|---|---|---|---|---|---|---|
| | | | content type | Shell 0<br>Average 10 | | | (ii) |

Emulsion A

Process A 67.7 ml of an aqueous solution containing 0.90 mol/l of $AgNO_3$ and 67.7 ml of an aqueous solution containing 0.85 mol/l of KBr and 0.04 mol/l of KI were added to an aqueous solution of gelatin (water: 1,350 ml; gelatin: 17 g; KBr: 3.7 g) at the same time at a constant flow rate in 45 seconds while the latter was kept at a temperature of 45° C. The admixture was then allowed to stand for 5 minutes. The temperature of the solution was then raised to 65° C. 241 g of 10% gelatin was added to the solution. The admixture was then allowed to stand for 30 minutes.

Process B

An aqueous solution containing 1.76 mol/l of $AgNO_3$ and an aqueous solution containing 2.72 mol/l of KBr and 0.249 mol/l of KI were then added to the solution prepared by Process A at a constant flow rate in 30 minutes while the pBr value of the system was kept at 3.5 until the consumed amount of the aqueous solution of $AgNO_3$ reached 310 ml.

Process C

An aqueous solution containing 1.76 mol/l of $AgNO_3$ and an aqueous solution containing 2.72 mol/l of KBr were then added to the solution prepared by Process B at a constant flow rate in 15 minutes while the pBr value of the system reached 3.5 until the consumed amount of the aqueous solution of $AgNO_3$ reached 345 ml.

Process D

After Process C was completed, the emulsion obtained by Process C was allowed to cool to 40° C. 1.65 l of a 15.3% solution of phthalated gelatin was added to the emulsion. The emulsion was then washed twice by a coagulation process described in U.S. Pat. No. 2,614,929. 0.55 l of a 10.5% solution of gelatin was then added to the emulsion to adjust the pH and pBr values thereof to 5.5 and 3.1 at a temperature of 40° C., respectively.

Emulsion B

Emulsion B was prepared in the same manner as in Emulsion A except that the iodine composition of the aqueous solution of halogen was adjusted so as to obtain a uniform iodine composition.

Emulsions C, F and H

Emulsions C, F and H can be prepared in accordance with an example in JP-A-52-153428.

Emulsions D and E

Emulsions D and E can be prepared in accordance with an example in JP-A-188639.

Emulsion G

Emulsion G was prepared in the same manner as Emulsion A except in that the pBr valve at Processes B and C was changed.

The emulsions were then subjected to optimum chemical sensitization using chemical sensitizers shown in Table 2 in accordance with their respective examples. These emulsions were then subjected to spectral sensitization. (As a sensitizing dye there was used ExS-4 of Example 3 in an amount shown in Table 2.)

TABLE 2

| Emulsion | Chemical Sensitizer: Potassium tetrachloroauric acid (mol/mol Ag) | Sodium thiosulfate pentahydrate (mol/mol Ag) | Sodium thiocyanate (mol/mol Ag) | Sensitizing Dye (mol/mol Ag) |
|---|---|---|---|---|
| A | 3.5 | 10.0 | 200 | 400 |
| B | " | " | 250 | " |
| C | " | " | " | 250 |
| D | " | " | " | 200 |
| E | " | " | 300 | " |
| F | " | " | " | 250 |
| G | " | " | 250 | 550 |
| H | " | " | 200 | 250 |

Emulsions A to H were each coated on a triacetyl cellulose film support having a subbing layer in amounts shown below.

Conditions of emulsion coating (1) Emulsion layer

Emulsion: Emulsions A to H shown in Table 1 ($2.1\times10^{-2}$ mol/m$^2$ as calculated in terms of silver)

Coupler: $1.5\times10^{-3}$ mol/m$^2$

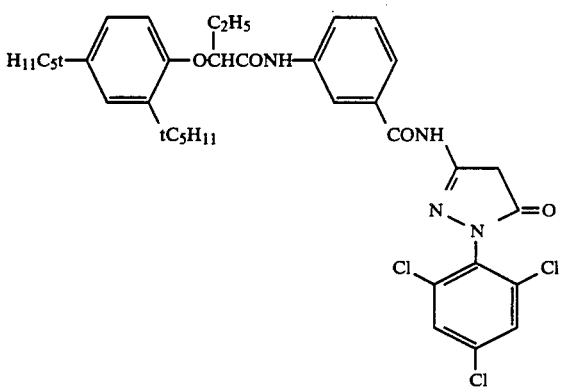

Tricresyl phosphate: 1.10 g/m$^2$
Gelatin: 2.30 g/m$^2$
(2) Protective layer
2,5-Dichlorotriazine-6-hydroxy-s-triazine sodium salt: 0.08 g/m$^2$
Gelatin: 1.80 g/m$^2$ These specimens were then allowed to stand at a temperature of 40° C. and a relative humidity of 70% for 14 hours. These specimens were then examined for pressure characteristics by Test Method A. These specimens were subjected to exposure for sensitometry and then to the undermentioned color development.

Test Method A

After being allowed to stand at a relative humidity of 55% for 3 hours, the specimen to be tested is scratched on the surface thereof at a rate of 1 cm/sec. by a 0.1-mm diameter needle with 4 g loaded thereon in the same atmosphere.

The development was conducted at a temperature of 38° C. under the following conditions:

1. Color development: 2 minutes 45 seconds
2. Bleaching: 6 minutes 30 seconds
3. Rinse: 3 minutes 15 seconds
4. Fixing: 6 minutes 30 seconds
5. Rinse: 3 minutes 15 seconds
6. Stabilization: 3 minutes 15 seconds The composition of the various processing solutions used at the above steps are as follows:

| | |
|---|---|
| Color developing solution | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-ethyl-N-β-hydroxylamino)-2-methyl-aniline sulfate | 4.5 g |
| Water to make | 1 l |
| Bleaching solution | |
| Ammonium bromide | 160.0 g |
| Aqueous ammonium (28%) | 25.0 ml |
| Ferric sodium ethylenediamine-tetraacetate | 130 g |
| Glacial acetic acid | 14 ml |
| Water to make | 1 l |
| Fixing solution | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 l |

-continued

| | |
|---|---|
| Stabilizing solution | |
| Formalin | 8.0 ml |
| Water to make | 1 l |

The specimens thus developed were measured by a 5 μm × 1 mm measurement slit to determine the density of pressured and unpressured portions.

Table 3 shows (1) fog increase due to pressure, ΔFog, (2) density change due to pressure at the exposure which gives a density of fog+0.2, $\Delta D_{0.2}$, (3) density change due to pressure at the exposure which gives a density of 1; $\Delta D_{1.0}$, (4) density change due to pressure at the exposure which gives a density of 1.5, and (5) pressure desensitization range. When the density decreases by 0.01 or more between the exposures $E_1$ and $E_2$ in the exposure range of 100 times or less the exposures $E_0$ which gives a density of fog+0.2, the pressure desensitization range is given by the following equation:

$$\text{Pressure desensitization range} = \frac{\log E_2 - \log E_1}{2 \log E_0} \times 100\ (\%)$$

TABLE 3

| Emulsion | ΔFog | $\Delta D_{0.2}$ | $\Delta D_{1.0}$ | $\Delta D_{1.0}$ | Pressure desensitization Range (%) |
|---|---|---|---|---|---|
| A | 0.20 | 0.13 | 0.07 | 0.05 | 0 |
| B | 0.22 | 0.16 | 0.08 | 0.05 | 0 |
| C | 0.12 | 0.10 | 0.04 | 0.02 | 20 |
| D | 0.09 | 0.07 | 0.02 | 0 | 25 |
| E | 0.05 | 0.02 | −0.03 | −0.05 | 55 |
| F | 0.05 | 0.03 | 0.0 | −0.02 | 40 |
| G | 0.23 | 0.15 | 0.08 | 0.05 | 0 |
| H | 0.06 | 0.04 | 0 | −0.04 | 45 |

Among the emulsion thus obtained, the emulsions of tabular grains having an aspect ratio of 2 or more (Emulsions A, B and G) are pressure-sensitizable regardless of their iodine composition. On the other hand, the core/shell type emulsions (Emulsions E, F and H) exhibit some pressure desensitization. Particularly, the core/shell type emulsions having a high monodispersibility exhibit a remarkable pressure desensitization. Therefore, in order to minimize the density change due to pressure at a gradation portion, it is necessary to use a combination of an emulsion which shows an increase in the density due to pressure (e.g., Emulsions A, B and G) with an emulsion which shows a decrease in the density due to pressure (e.g., Emulsions E, F and H).

EXAMPLE 2

Combinations of two emulsions selected from the emulsions prepared in Example 1 were each coated on a support as shown in Table 4. These specimens were then subjected to a test for pressure characteristics in the same manner as in Example 1.

The coating was conducted in accordance with the conditions as used in Example 1. The 1st layer and the 2nd layer were coated on the support in this order in amounts such that the molar ratio of the silver content in the 1st emulsion layer to that in the 2nd emulsion layer reached 1:1 and the coated amount of silver reached 2 g/m$^2$.

TABLE 4

| Specimen No. | 1st Emulsion layer | 2nd Emulsion layer | ΔFog | $\Delta D_{0.2}$ | $\Delta D_{1.0}$ | $\Delta D_{1.5}$ | Remarks |
|---|---|---|---|---|---|---|---|
| 1 | A | C | 0.16 | 0.12 | 0.06 | 0.04 | Present invention |
| 2 | A | D | 0.14 | 0.11 | 0.06 | 0.03 | Present invention |
| 3 | A | E | 0.12 | 0.05 | 0 | −0.01 | Present invention |
| 4 | A | F | 0.12 | 0.06 | 0.02 | 0.01 | Present invention |
| 5 | B | C | 0.16 | 0.13 | 0.07 | 0.04 | Present invention |
| 6 | B | F | 0.14 | 0.06 | 0.03 | 0.01 | Present invention |
| 7 | A | G | 0.20 | 0.18 | 0.12 | 0.07 | Comparison |
| 8 | F | H | 0.06 | 0 | −0.07 | −0.10 | Comparison |

Thus, it can be seen that the present specimens exhibit a small density change due to pressure at gradation portions. As an emulsion to be combined with an emulsion of tabular grains having an aspect ratio of at least 2, there may be preferably used an internal high iodine content core/shell type emulsion, particularly a monodisperse core/shell emulsion.

EXAMPLE 3

Four specimens shown in Table 5 were prepared by incorporating the emulsions prepared in Example 1 in a multilayer color light-sensitive material (1) composed of the following layer structure.

Multilayer color light-sensitive material (1)

The coated amount of silver halide and colloidal silver is represented in terms of amount of silver (g/m²). The coated amount of coupler, additives and gelatin is represented in g/m². The coated amount of sensitizing dye is represented by molar amount per 1 mol of silver halide incorporated in the same layer.

| | |
|---|---|
| 1st layer: antihalation layer | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| 2nd layer: intermediate layer | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| 3rd layer: low sensitivity red-sensitive emulsion layer | |
| Silver iodobromide emulsion (AgI content: 4 mol %, uniform AgI type; diameter as calculated in terms of a sphere: 0.5 μm; coefficient of variation in diameter as calculated in terms of a sphere: 20%; tabular grain; diameter/thickness ratio: 3.0) | 1.2 |
| Silver iodobromide emulsion (AgI content: 3 mol %, uniform AgI type; diameter as calculated in terms of a sphere: 0.3 μm; coefficient of variation in diameter as calculated in terms of a sphere: 15%; spherical grain; diameter/thickness ratio: 1.0) | 0.6 |
| Gelatin | 1.0 |
| ExS-1 | $4 \times 10^{-4}$ |

-continued

| | |
|---|---|
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| 4th layer: high sensitivity red-sensitive emulsion layer | |
| Silver iodobromide emulsion (AgI content: 6 mol %, internal high AgI content type with a core/shell ratio of 1:1; diameter as calculated in terms of a sphere: 0.7 μm; coefficient of variation in diameter as calculated in terms of a sphere: 15%; tabular grain; diameter/thickness ratio: 5.0) | 0.7 |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| 5th layer: intermediate layer | |
| Gelatin | 0.5 |
| Cpd-1 | 0.1 |
| Solv-1 | 0.05 |
| 6th layer: low sensitivity green-sensitive emulsion layer | |
| Silver iodobromide emulsion (same as described in Table 5) | 0.35 |
| Silver iodobromide emulsion (AgI content: 3 mol %, uniform AgI type; diameter as calculated in terms of a sphere: 0.3 μm; coefficient of variation in diameter as calculated in terms of a sphere: 25%; spherical grain; diameter/thickness ratio: 1.0) | 0.20 |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| 7th layer: high sensitivity green-sensitive emulsion layer | |
| Silver iodobromide emulsion (same as described in Table 5) | 0.7 |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |

-continued

| | |
|---|---|
| ExM-14 | 0.01 |
| Solv-1 | 0.2 |
| Solv-4 | 0.01 |
| 8th layer: intermediate layer | |
| Gelatin | 0.5 |
| Cpd-1 | 0.05 |
| Solv-1 | 0.02 |
| 9th layer: donor layer having an interimage effect with respect to red-sensitive layer | |
| Silver iodobromide emulsion (AgI content: 2 mol %, internal high AgI content type with a core/shell ratio of 2:1; diameter as calculated in terms of a sphere: 1.0 μm; coefficient of variation in diameter as calculated in terms of a sphere: 15%; tabular grain; diameter/thickness ratio: 6.0) | 0.35 |
| Silver iodobromide emulsion (AgI content: 2 mol %, internal high AgI content type with a core/shell ratio of 1:1; diameter as calculated in terms of a sphere: 0.4 μm; coefficient of variation in diameter as calculated in terms of a sphere: 20%; tabular grain; diameter/thickness ratio: 6.0) | 0.20 |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| 10th layer: yellow filter layer | |
| Yellow colloidal silver | 0.05 |
| Gelatin | 0.5 |
| Cpd-2 | 0.13 |
| Solv-1 | 0.13 |
| Cpd-1 | 0.10 |
| 11th layer: low sensitivity blue-sensitive emulsion layer | |
| Silver iodobromide emulsion (AgI content: 3 mol %, uniform AgI type; diameter as calculated in terms of a sphere: 0.5 μm; coefficient of variation in diameter as calculated in terms of a sphere: 25%; tabular grain; diameter/thickness ratio: 7.0) | 0.45 |
| Gelatin | 1.6 |
| ExS-6 | $2 \times 10^{-4}$ |

-continued

| | |
|---|---|
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| 12th layer: high sensitivity blue-sensitive emulsion layer | |
| Silver iodobromide emulsion (AgI content: 10 mol %, uniform AgI type; diameter as calculated in terms of a sphere: 1.0 μm; coefficient of variation in diameter as calculated in terms of a sphere: 25%; multiple twin tabular grain; diameter/thickness ratio: 2.0) | 0.5 |
| Gelatin | 0.5 |
| ExS-6 | $1 \times 10^{-4}$ |
| ExY-15 | 0.20 |
| ExY-13 | 0.01 |
| Solv-1 | 0.10 |
| 13th layer: 1st protective layer | |
| Gelatin | 0.8 |
| UV-4 | 0.1 |
| UV-5 | 0.15 |
| Solv-1 | 0.01 |
| Solv-2 | 0.01 |
| 14th layer: 2nd protective layer | |
| Emulsion of finely divided grains of silver iodobromide (AgI content: 2 mol %; uniform AgI type; diameter as calculated in terms of a sphere: 0.07 μm) | 0.5 |
| Gelatin | 0.45 |
| Particulate polymethyl methacrylate (diameter: 1.5 μm) | 0.2 |
| H-1 | 0.4 |
| Cpd-5 | 0.5 |
| Cpd-6 | 0.5 |

Besides the above described components, an emulsion stabilizer Cpd-3 and a surface active agent Cpd-4 were incorporated in each layer as coating aid in amount of 0.04 g/m$^2$ and 0.02 g/m$^2$, respectively, The "core/shell ratio" as used herein is a molar ratio of the amount of silver contained in core to the amount of silver contained in shell.

Tricresyl phosphate — Solv-1

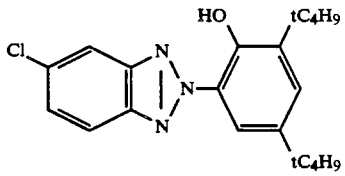

UV-1

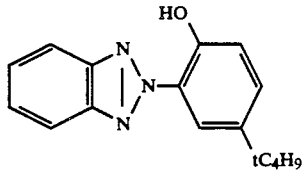

UV-2

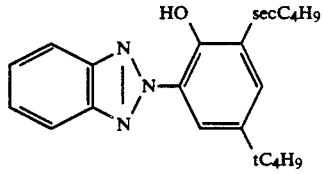

UV-3

-continued
UV-4
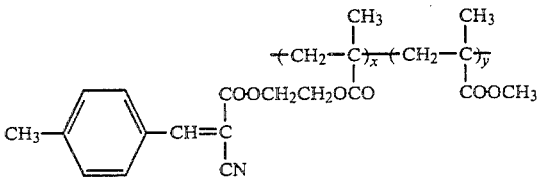
(x/y = 7/3 (weight ratio))
UV-5
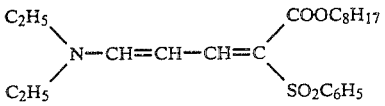
Dibutyl phthalate
Solv-2
Solv-3
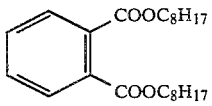
Solv-4
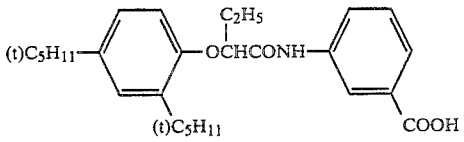
Cpd-1
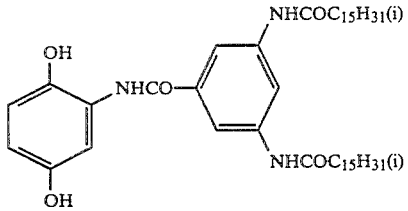
Cpd-2
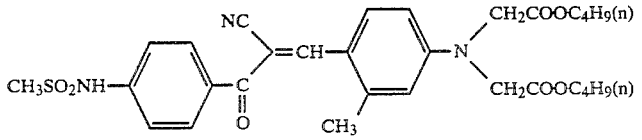
Cpd-3
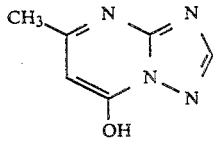
Cpd-4
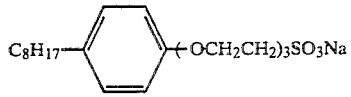
Cpd-5
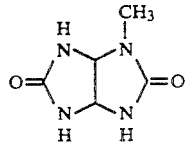
Cpd-6
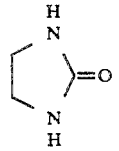

-continued
ExC-1
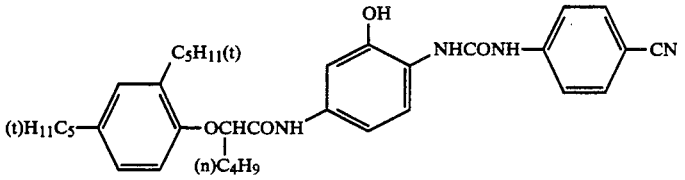
ExC-2
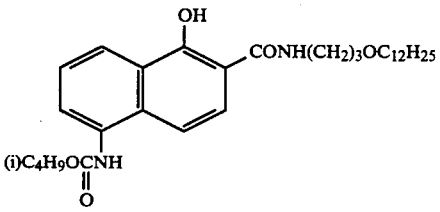
ExC-3
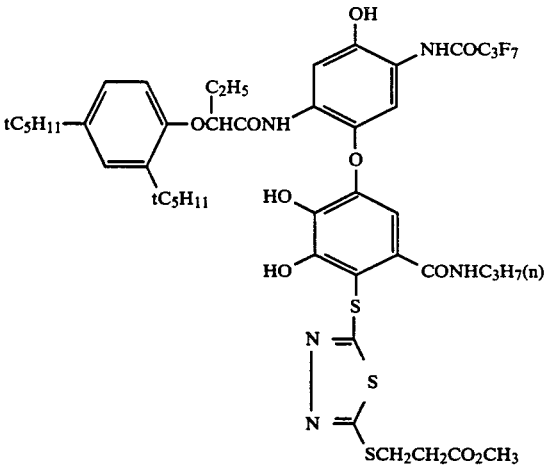
ExC-4
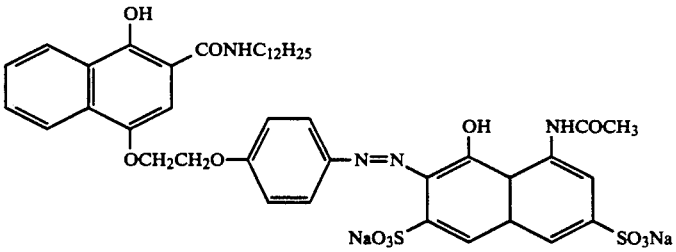
ExC-5
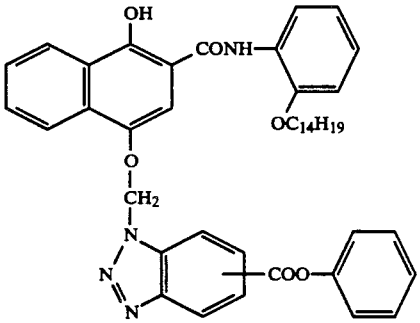

-continued
ExC-6
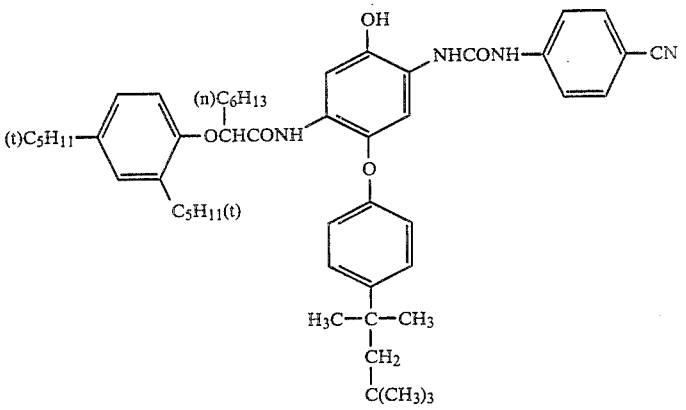
ExC-7
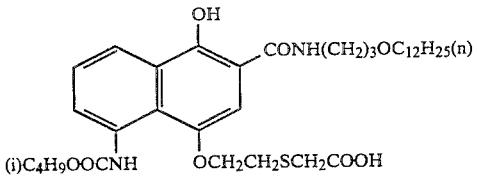
ExM-8
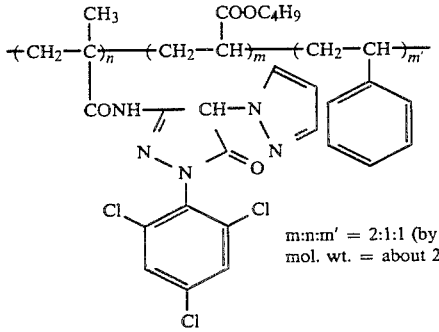
m:n:m' = 2:1:1 (by weight)
mol. wt. = about 20,000
ExM-9
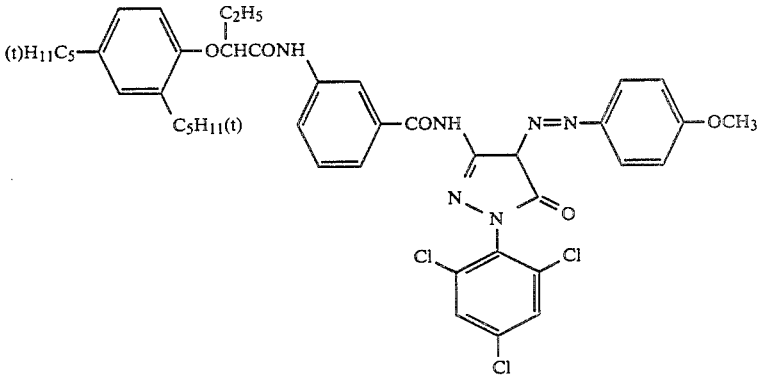
ExM-10
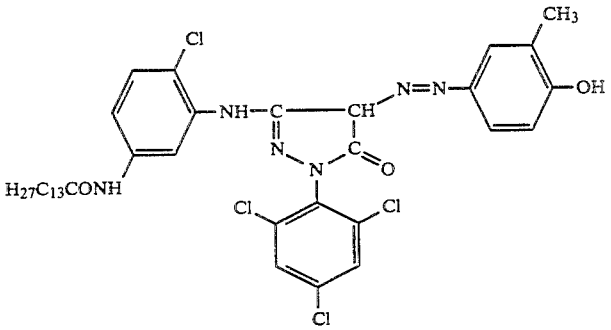

-continued
ExY-11
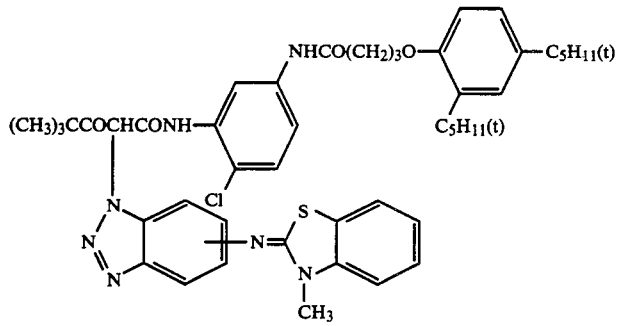
ExM-12
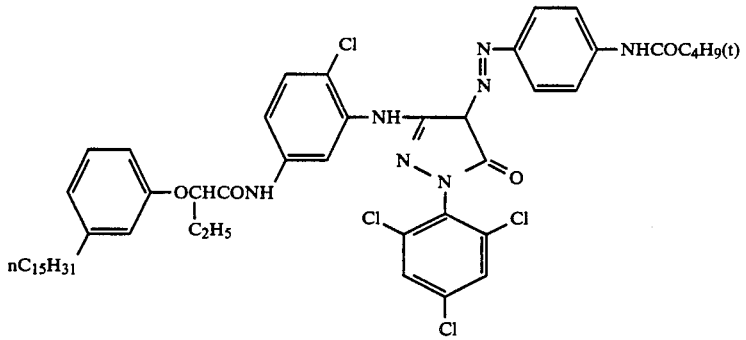
ExY-13
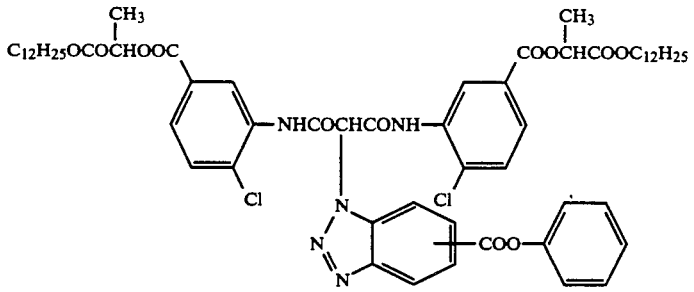
ExM-14
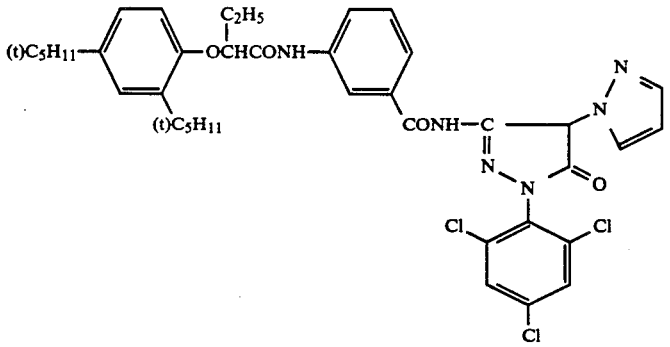
ExY-15
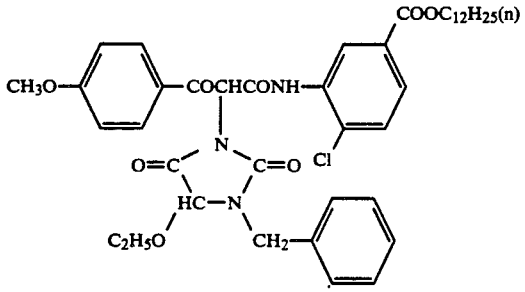

-continued
ExC-16
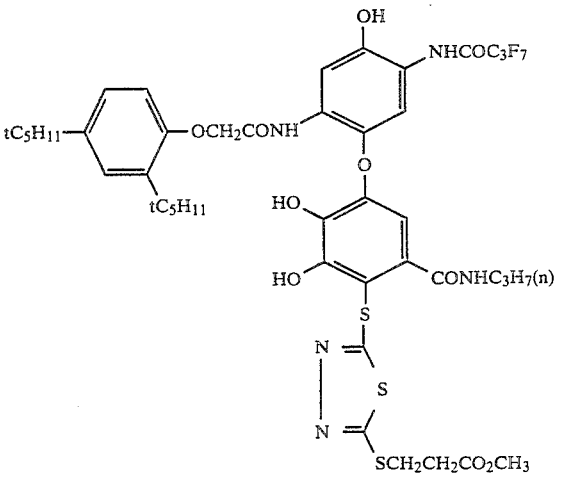
ExS-1
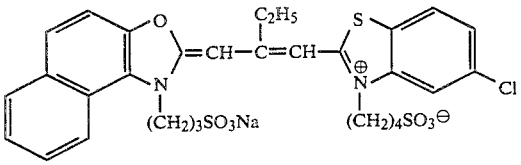
ExS-2
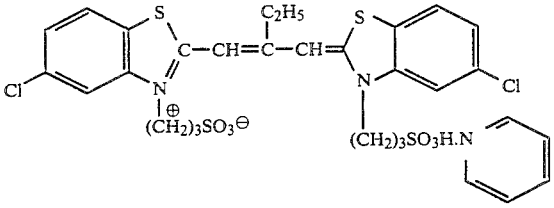
ExS-3
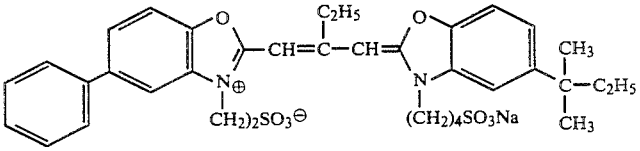
ExS-4
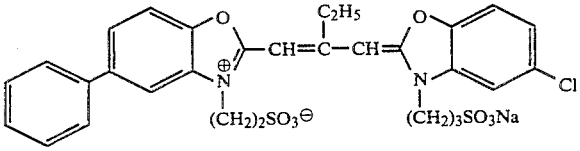
ExS-5
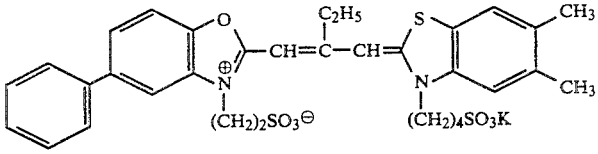
ExS-6
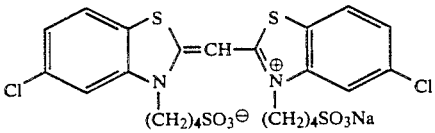
H-1
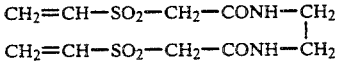

-continued

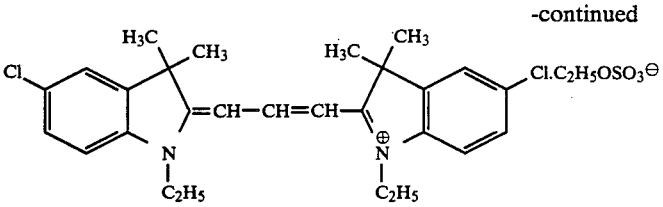

EXF-1

TABLE 5

| Specimen No. | Emulsion incorporated in 6th layer | Emulsion incorporated in 7th layer | Remarks |
|---|---|---|---|
| 9 | B | G | Comparative |
| 10 | B | E | Present Invention |
| 11 | B | F | Present Invention |
| 12 | A | E | Present Invention |

Specimens 9 to 12 shown in Table 5 were then subjected to a pressure test in the same manner as in Example 2.

The specimens thus pressured were exposed to white light of 10 CMS for 1/100 second. These specimens were then developed in the same manner as in Example 1 (color development was effected for 3 minutes and 15 seconds). These specimens were then measured for magenta density in the same manner as described in Example 2. Table 6 shows the pressure characteristics of Specimens 9 to 12 ((1) fog change due to pressure, ΔFog, (2) density change due to pressure at the exposure which gives a density of fog+0.2, $\Delta D_{0.2}$, and (3) density change due to pressure at the exposure which gives a density of 1.5, $\Delta D_{1.5}$).

TABLE 6

| Specimen No. | ΔFog | $\Delta D_{0.2}$ | $\Delta D_{1.5}$ | Remarks |
|---|---|---|---|---|
| 9 | 0.14 | 0.08 | 0.04 | Comparative example |
| 10 | 0.09 | 0 | −0.01 | Present Invention |
| 11 | 0.10 | 0.02 | −0.01 | " |
| 12 | 0.09 | 0 | −0.02 | " |

Table 6 shows that the present multilayer color photographic light-sensitive materials exhibit an improved density change at the gradation portion due to the use of a pressure-desensitizable emulsion (comparison between Specimens 9 and 12). Furthermore, the monodisperse core/shell type emulsion was further effective for the improvement in the pressure characteristics (comparison between Specimens 10 and 11).

EXAMPLE 4

Specimens 13, 14 and 15 were prepared in the same manner as specimen 9 in Example 3 except that the present emulsions were incorporated in the 11th and 12th layers. These specimens were then evaluated for the pressure characteristics with respect to yellow (Table 7).

TABLE 7

| Specimen No. | Emulsion incorporated in 11th layer | Emulsion incorporated in 12th layer | ΔFog | $\Delta D_{0.2}$ | $\Delta D_{1.5}$ | Remarks |
|---|---|---|---|---|---|---|
| 13 | B | G | 0.20 | 0.16 | 0.04 | Comparison |

TABLE 7-continued

| Specimen No. | Emulsion incorporated in 11th layer | Emulsion incorporated in 12th layer | ΔFog | $\Delta D_{0.2}$ | $\Delta D_{1.5}$ | Remarks |
|---|---|---|---|---|---|---|
| 14 | B | E | 0.13 | 0.05 | −0.01 | Invention |
| 15 | B | F | 0.15 | 0.07 | 0 | " |

The blue-sensitive layer exhibited the same effects as shown in Example 3.

EXAMPLE 5

The four specimens shown in Table 8 were prepared by incorporating the emulsions prepared in Example 1 in a multilayer color light-sensitive material (2) of the compositions shown below.

Multilayer color light-sensitive material (2)

The coated amount of each component is represented in g/m². The coated amount of silver halide is represented in terms of amount of silver (g/m²). The coated amount of sensitizing dye is represented by molar amount per 1 mol of silver halide incorporated in the same layer.

| | |
|---|---|
| 1st layer: antihalation layer | |
| Black colloidal silver | 0.2 |
| Gelatin | 2.6 |
| Cpd-3' | 0.2 |
| Solv-1' | 0.02 |
| 2nd layer: intermediate layer | |
| Finely divided silver bromide grains (average grain diameter: 0.07 μm) | 0.15 |
| Gelatin | 1.0 |
| 3rd layer: low sensitivity red-sensitive emulsion layer | |
| Monodisperse silver iodobromide emulsion (silver iodide content: 5.5 mol %; average grain diameter: 0.3 μm; coefficient of variation in grain diameter (hereinafter referred to as "coefficient of variation"): 19%) | 1.5 |
| Gelatin | 3.0 |
| ExS-1' | $2.0 \times 10^{-4}$ |
| ExS-2' | $1.0 \times 10^{-4}$ |
| ExS-3' | $0.3 \times 10^{-4}$ |
| ExC-1' | 0.7 |
| ExC-2' | 0.1 |
| ExC-6' | 0.02 |
| Cpd-1' | 0.01 |
| Solv-1' | 0.8 |
| Solv-2' | 0.2 |
| Solv-4' | 0.1 |
| 4th layer: high sensitivity red-sensitive emulsion layer | |
| Monodisperse silver iodobromide emulsion (silver iodide content: 3.5 mol %; average grain diameter: 0.7 μm; coefficient of variation: 18%) | 1.2 |
| Gelatin | 2.5 |
| ExS-1' | $3.0 \times 10^{-4}$ |
| ExS-2' | $1.5 \times 10^{-4}$ |
| ExS-3' | $0.45 \times 10^{-4}$ |
| ExC-4' | 0.15 |
| ExC-5' | 0.05 |

-continued

| | |
|---|---|
| ExC-2' | 0.03 |
| ExC-6' | 0.01 |
| Solv-1' | 0.05 |
| Solv-2' | 0.3 |
| 5th layer: intermediate layer | |
| Gelatin | 0.8 |
| Cpd-2' | 0.05 |
| Solv-3' | 0.01 |
| 6th layer: low sensitivity green-sensitive emulsion layer | |
| Monodisperse silver iodobromide emulsion (silver iodide content: 5 mol %; average grain diameter: 0.3 μm; coefficient of variation: 19%) | 0.4 |
| Monodisperse silver iodobromide emulsion (same as described in Table 8) | 0.8 |
| Gelatin | 3.0 |
| ExS-4' | $1 \times 10^{-4}$ |
| ExS-5' | $4 \times 10^{-4}$ |
| ExS-6' | $1 \times 10^{-4}$ |
| ExM-9' | 0.2 |
| ExM-7' | 0.4 |
| ExM-10' | 0.16 |
| ExC-9' | 0.05 |
| Solv-2' | 1.2 |
| Solv-4' | 0.05 |
| Solv-5' | 0.01 |
| 7th layer: high sensitivity green-sensitive emulsion layer | |
| Polydisperse silver iodobromide emulsion (same as described in Table 8) | 0.9 |
| Gelatin | 1.6 |
| ExS-4' | $0.7 \times 10^{-4}$ |
| ExS-5' | $2.8 \times 10^{-4}$ |
| ExS-6' | $0.7 \times 10^{-4}$ |
| ExM-7' | 0.05 |
| ExM-10' | 0.04 |
| ExC-9' | 0.01 |
| Solv-1' | 0.08 |
| Solv-2' | 0.3 |
| Solv-4' | 0.03 |
| 8th layer: yellow filter layer | |
| Yellow colloidal silver | 0.2 |
| Gelatin | 0.9 |
| Cpd-2' | 0.2 |
| Solv-2' | 0.1 |
| 9th layer: low sensitivity blue sensitive emulsion layer | |
| Monodisperse silver iodobromide emulsion (silver iodide content: 6 mol %; average grain diameter: 0.3 μm; coefficient of variation: 20%) | 0.4 |
| Monodisperse silver iodobromide emulsion (silver iodide content: 5 mol %; average grain diameter: 0.6 μm; coefficient of variation: 17%) | 0.4 |
| Gelatin | 2.9 |
| ExS-7' | $1 \times 10^{-4}$ |
| ExS-8' | $1 \times 10^{-4}$ |
| ExY-10' | 0.8 |
| ExY-11' | 0.4 |
| ExC-3' | 0.05 |
| Solv-2' | 0.4 |
| Solv-4' | 0.1 |
| 10th layer: high sensitivity blue-sensitive emulsion layer | |
| Monodisperse silver iodobromide emulsion (silver iodide content: 6 mol %; average grain diameter: 1.5 μm; coefficient of variation: 14%) | 0.5 |
| Gelatin | 2.2 |
| ExS-7' | $5 \times 10^{-5}$ |
| ExS-8' | $5 \times 10^{-5}$ |
| ExY-10' | 0.2 |
| ExY-11' | 0.2 |
| ExC-3' | 0.02 |
| Solv-2' | 0.1 |
| 11th layer: 1st protective layer | |
| Gelatin | 1.0 |
| Cpd-3' | 0.1 |
| Cpd-4' | 0.1 |
| Cpd-5' | 0.1 |
| Cpd-6' | 0.1 |
| Solv-1' | 0.1 |
| Solv-4' | 0.1 |
| 12th layer: 2nd protective layer | |
| Finely divided silver bromide grains (average grain diameter: 0.07 μm) | 0.25 |
| Gelatin | 1.0 |
| Particulate polymethyl methacrylate (diameter: 1.5 μm) | 0.2 |
| Cpd-8' | 0.5 |

Besides the above described components, a surface active agent Cpd-7' and a hardener H-1' were incorporated in each layer.

ExS-1'

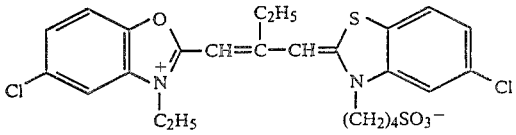

ExS-2'

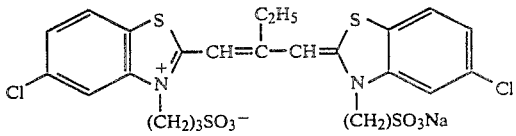

ExS-3'

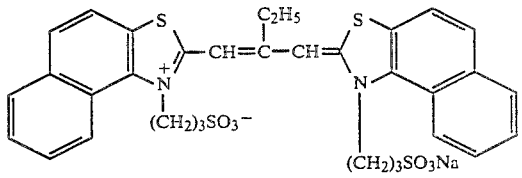

ExS-4'

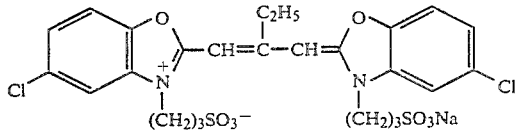

-continued
ExS-5'
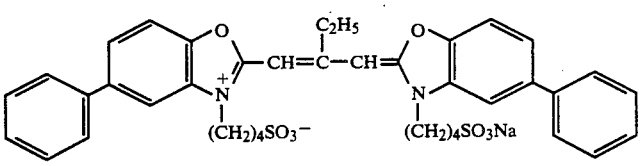
ExS-6'
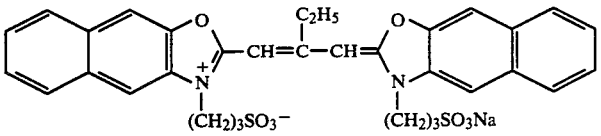
ExS-7'
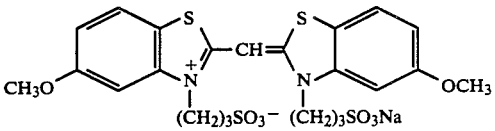
ExS-8'
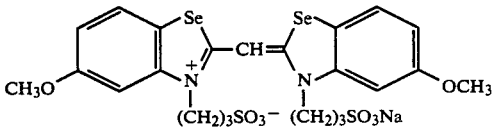
ExC-4'
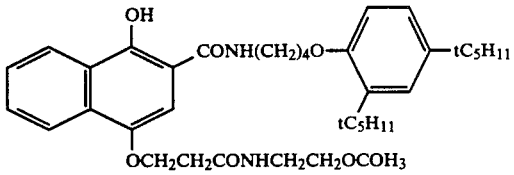
ExC-5'
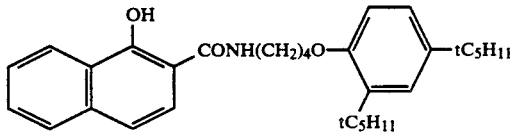
ExC-1'
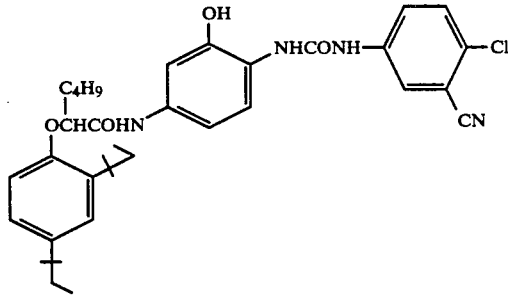
ExC-6'
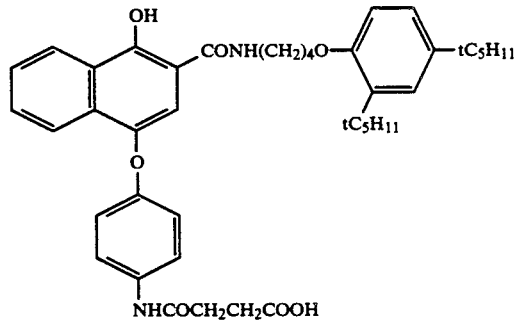

-continued
ExC-2'
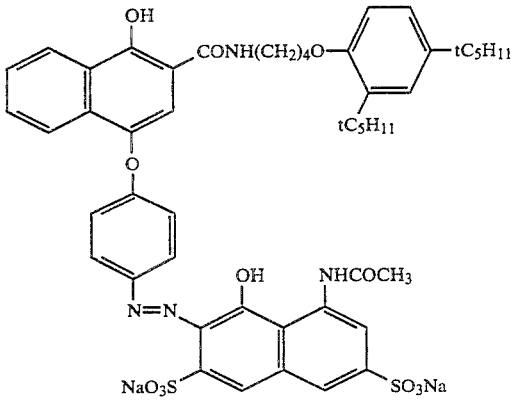
ExM-7'
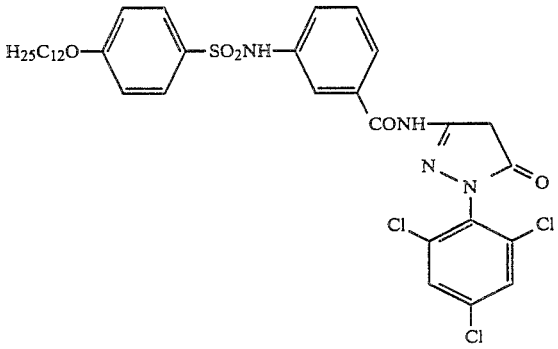
ExM-9'
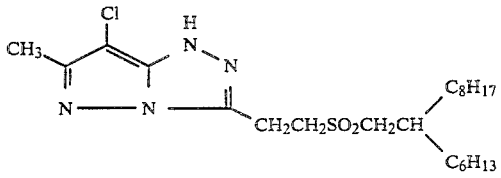
ExM-10'
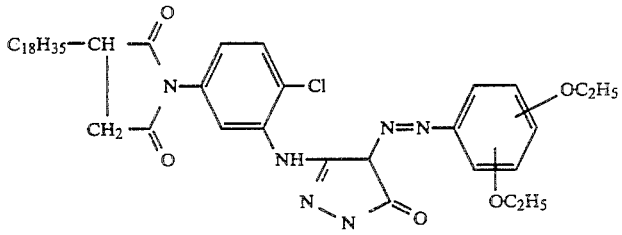
ExY-10'
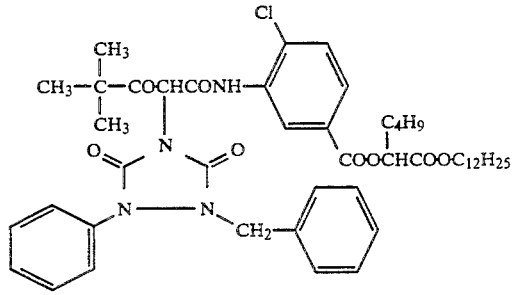

-continued
ExY-11'
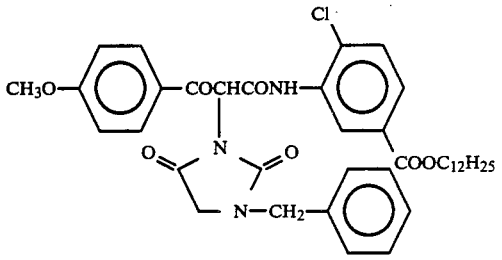
ExC-3'
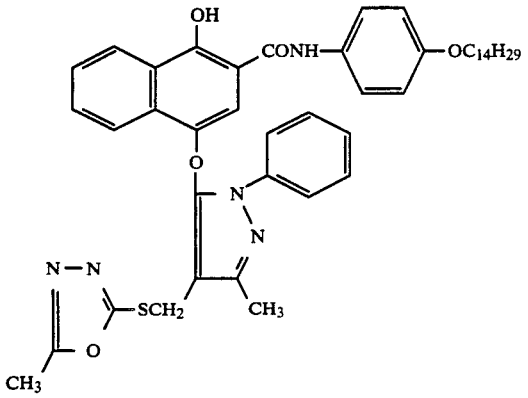
ExC-9'
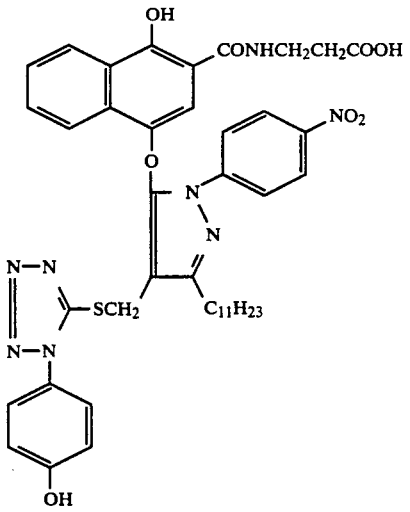
Cpd-1'
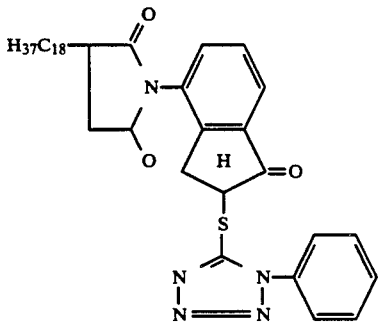
Cpd-2'
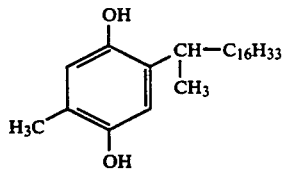

-continued
Cpd-3'
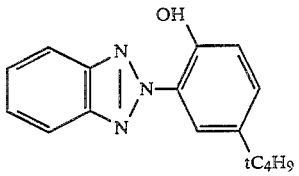
Cpd-4'
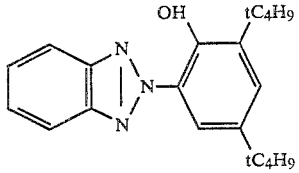
Cpd-5'
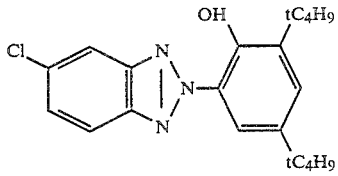
Cpd-6'
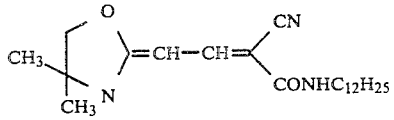
Solv-1'
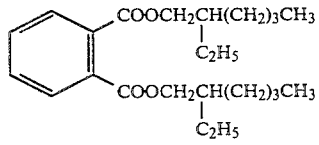
Solv-2'
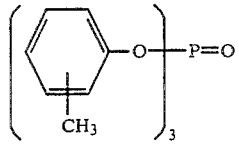
Solv-3'
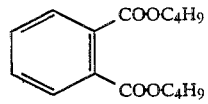
Solv-4'
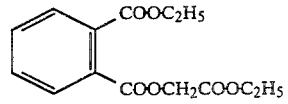
Solv-5'
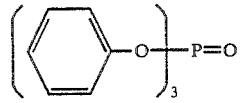
Cpd-7'
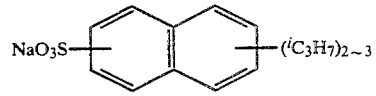
Cpd-8'
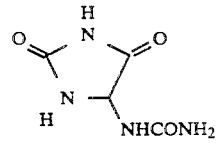

-continued

H-1'

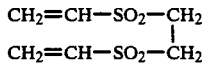

These specimens were then imagewise exposed to light of 10 CMS at maximum from tungsten light source (color temperature: 2,854° K.) which had been adjusted by a color temperature conversion filter to 4,800° K. These specimens were then color developed at a temperature of 38° C. for the evaluation of photographic properties.

TABLE 8

| Specimen No. | Emulsion incorporated in 6th layer | Emulsion incorporated in 7th layer | Remarks |
|---|---|---|---|
| 16 | B | G | Comparison |
| 17 | B | D | " |
| 18 | B | E | Invention |
| 19 | B | F | " |

Specimens 16 to 19 shown in Table 8 were then evaluated for the pressure characteristics in accordance with the conditions as used in Example 3. The results are shown in Table 9.

TABLE 9

| Specimen No. | ΔFog | $\Delta D_{0.2}$ | $\Delta D_{1.5}$ | Remarks |
|---|---|---|---|---|
| 16 | 0.45 | 0.31 | 0.07 | Comparative example |
| 17 | 0.40 | 0.24 | 0.04 | " |
| 18 | 0.30 | 0.14 | 0.01 | Present invention |
| 19 | 0.35 | 0.15 | 0.02 | " |

Thus, the combination of tabular grains having an aspect ratio of 2 or more and a pressure-desensitizable emulsion enables an improvement in pressure characteristics.

EXAMPLE 6

Specimens 9 to 12 prepared in Example 3 were exposed to white light of 10 CMS for 1/100 second. These specimens were then processed in the processing steps as shown in Table 10. The same results as in Example 3 were obtained. Units are grams (g), unless otherwise indicated.

TABLE 10

| Processing Step | Processing time | Processing temperature |
|---|---|---|
| Color development | 3 min. 15 sec. | 38° C. |
| Bleach | 1 min. 00 sec. | 38° C. |
| Blix | 3 min. 15 sec. | 38° C. |
| Rinse (1) | 40 sec. | 35° C. |
| Rinse (2) | 1 min. 00 sec. | 35° C. |
| Stabilization | 40 sec. | 38° C. |
| Drying | 1 min. 15 sec. | 55° C. |

The composition of the various processing solutions will described hereinafter.

| Color developing solution | |
|---|---|
| Diethylenetrimainepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |

-continued

| | |
|---|---|
| 4-[N-ethyl-N-(β-hydroxyethyl)amino]-2-methylaniline sulfate | 4.5 g |
| Water to make | 1.0 l |
| pH | 10.05 |
| Bleaching solution | |
| Ferric ammonium ethylenediamine-tetraacetate (dihydrate) | 120.0 g |
| Disodium ethylenediaminetetraacetate | 10.0 g |
| Ammonium bromide | 100.0 g |
| Ammonium nitrate | 10.0 g |
| Bleach accelerator: | 0.005 mol |

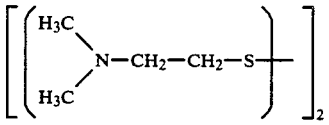

| | |
|---|---|
| Aqueous ammonia (27%) | 15.0 ml |
| Water to make | 1.0 l |
| pH | 6.3 |
| Blix solution | |
| Ferric ammonium ethylenediamine-tetraacetate (dihydrate) | 50.0 g |
| Disodium ethylenediaminetetraacetate | 5.0 g |
| Sodium sulfite | 12.0 g |
| Aqueous solution of ammonium thiosulfate (70%) | 240.0 ml |
| Aqueous ammonia (27%) | 6.0 ml |
| Water to make | 1.0 l |
| pH | 7.2 |

Rinsing solution

Tap water was passed through a mixed bed column filled with a strongly acidic H-type cation exchange resin (Amberlite IR-120B made by Rohm & Haas Inc.) and an OH—type anion exchange resin (Amberlite IR-400 made by Rohm & Haas Inc.) so that the concentration of calcium and magnesium each reached 3 mg/l or less. Sodium dichlorinated isocyanurate and sodium sulfate were added to the solution in amounts of 20 g/l and 1.5 g/l, respectively.

The pH of the solution thus prepared was in the range of 6.5 to 7.5.

| Stabilizing solution | |
|---|---|
| Formalin | 2.0 ml |
| Polyoxyethylene-p-monononylphenyl-ether (average polymerization degree: 10) | 0.3 g |
| Disodium ethylenediaminetetraacetate | 0.05 g |
| Water to make | 1.0 l |
| pH | 5.0 to 8.0 |

EXAMPLE 7

Specimens 9 to 12 prepared in Example 3 were exposed to white light of 10 CMS for 1/100 second. These specimens were then processed in the processing steps as shown in Table 11. The same results as in Example 3 were obtained. Units are grams, unless otherwise indicated.

TABLE 11

| Processing Step | Processing time | Processing temperature |
|---|---|---|
| Color development | 2 min. 30 sec. | 40° C. |
| Blix | 3 min. 00 sec. | 40° C. |
| Rinse (1) | 20 sec. | 35° C. |
| Rinse (2) | 20 sec. | 35° C. |
| Stabilization | 20 sec. | 35° C. |
| Drying | 50 sec. | 65° C. |

The composition of the various processing solutions used will be described hereinafter.

| | |
|---|---|
| Color developing solution | |
| Diethylenetrimainepentaacetic acid | 2.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-[N-ethyl-N-(β-hydroxyethyl)amino]-2-methylaniline sulfate | 4.5 g |
| Water to make | 1.0 l |
| pH | 10.05 |
| Blix solution | |
| Ferric ammonium ethylenediamine-tetraacetate (dihydrate) | 50.0 g |
| Disodium ethylenediaminetetraacetate | 5.0 g |
| Sodium sulfite | 12.0 g |
| Aqueous solution of ammonium thiosulfate (70%) | 260.0 ml |
| Acetic acid (98%) | 5.0 ml |
| Bleach accelerator: | 0.01 mol |

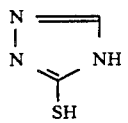

| | |
|---|---|
| Water to make | 1.0 l |
| pH | 6.0 |

Rinsing solution

Tap water was passed through a mixed bed column filled with a strongly acidic H-type cation exchange resin (Amberlite IR-120B made by Rohm & Haas Inc.) and an OH-type anion exchange resin (Amberlite IR-400 made by Rohm & Haas Inc.) so that the concentration of calcium and magnesium each reached 3 mg/l or less. Sodium dichlorinated isocyanurate and sodium sulfate were added to the solution in amounts of 20 mg/l and 1.5 g/l, respectively.

The pH of the solution thus prepared was in the range of 6.5 to 7.5.

| Stabilizing solution | |
|---|---|
| Formalin (37%) | 2.0 ml |
| Polyoxyethylene-p-monononylphenylether (average polymerization degree: 10) | 0.3 g |

-continued

| Stabilizing solution | |
|---|---|
| Disodium ethylenediaminetetraacetate | 0.05 g |
| Water to make | 1.0 l |
| pH | 5.0 to 8.0 |

While the invention has been described in detail and with reference to specific embodiments thereof, it will be apparent to one skilled in the art that various changes and modifications can be made therein without departing from the spirit and scope thereof.

What is claimed is:

1. A sliver halide photographic material comprising a support having thereon at least one silver halide emulsion layer, wherein the silver halide emulsion layer comprises a silver halide emulsion which satisfies condition (i) and wherein said silver halide emulsion layer or another silver halide emulsion layer having the same color sensitivity as that of said silver halide emulsion layer comprises a silver halide emulsion which satisfies condition (ii):

Condition (i): (1) tabular grains having at least two twinning planes, a diameter of at least 0.15 μm and an average aspect ratio of 2 to 8 accounting for at least 70% of silver halide grains as calculated in terms of projected area and (2) grains having a (b/a) ratio of at least 5 wherein (a) is the longest distance between the two or more parallel twinning planes and (b) is the grain thickness accounting for at least 50% of said tabular grains by number;

Condition (ii): core/shell structure grains with the core comprising silver haloiodide having a silver iodide content of at least 5 mol % and with the shell having a silver iodide content at least 5 mol % lower than the silver iodide content of the core and with the core/shell structure grains having a diameter of at least 0.15 μm and an average aspect ratio of less than 2 accounting for at least 70% of silver halide grains as calculated in terms of projected area.

2. A silver halide photographic material as claimed in claim 1, wherein the silver halide composition of the core of silver halide grains present in the emulsion satisfying Condition (ii) is silver iodobromide having a silver iodide content of 10 to 40 mol %, the silver iodide content of the shell of said silver halide grains being at least 5 mol % lower than that of the core.

3. A silver halide photographic material as claimed in claim 1, wherein the silver halide composition of the core of silver halide grains present in the emulsion satisfying Condition (ii) is silver iodobromide having a silver iodide content of 20 to 40 mol %, the silver iodide content of the shell of said silver halide grains being at least 5 mol % lower than that of the core.

4. A silver halide photographic material as claimed in claim 1, wherein the coefficient of variation in the diameter of said silver halide grains present in the silver halide emulsion satisfying Condition (ii) as calculated in terms of projected area is 20% or less.

* * * * *